US007350341B1

(12) United States Patent
Newell

(10) Patent No.: US 7,350,341 B1
(45) Date of Patent: Apr. 1, 2008

(54) BIT GUARD

(75) Inventor: Danny Leon Newell, Saranac, MI (US)

(73) Assignee: Newell Products, LLC, Saranac, MI (US)

( * ) Notice: Subject to any disclaimer, the term of this patent is extended or adjusted under 35 U.S.C. 154(b) by 0 days.

(21) Appl. No.: 11/734,460

(22) Filed: Apr. 12, 2007

(51) Int. Cl.
*B68B 1/06* (2006.01)

(52) U.S. Cl. ..... 54/7

(58) Field of Classification Search ..... 54/7–9, 54/14, 6.1, 6.2; 47/31.1, 32, 41.15, 32.7; 220/375, 229, 705, 713, 712
See application file for complete search history.

(56) References Cited

U.S. PATENT DOCUMENTS 243,684 A * 7/1881 Brooks ..... 54/7
351,007 A * 10/1886 Tickner ..... 54/7
420,721 A * 2/1890 Fancher ..... 54/7
514,779 A * 2/1894 Sears ..... 54/7
2,172,501 A * 9/1939 Barker ..... 54/7
2,652,671 A * 9/1953 Griffiths ..... 54/6.1
4,274,246 A * 6/1981 Stewart ..... 54/6.1
5,396,731 A * 3/1995 Byrne ..... 47/32
2005/0077372 A1* 4/2005 Greenberg ..... 239/33

OTHER PUBLICATIONS

Neoprene Bit Guards, www.horse.com, Jun. 15, 2006.*

* cited by examiner

*Primary Examiner*—Son T. Nguyen
(74) *Attorney, Agent, or Firm*—Price, Heneveld, Cooper, DeWitt & Litton LLP

(57) ABSTRACT

A mouth protection apparatus includes a substantially planar bit guard including first and second sides, and an inner aperture with first and second removable arcuate members. A first connection edge is releasably engageable with a second connection edge, wherein the first connection edge and the second connection edge define a first slit that intersects the inner aperture. A first tab extends from the first connection edge and is engaged with a first tab receiving aperture disposed proximate the second connection edge. A second tab extends from the second connection edge and is engaged with a second tab receiving aperture disposed proximate the first connection edge.

18 Claims, 2 Drawing Sheets

BIT GUARD

BACKGROUND OF THE PRESENT INVENTION

The present invention relates to a mouth protection apparatus and, more specifically, to a bit guard having a construction that allows for easy installation and removal and is designed to properly fit a variety of bit sizes.

Bridle assemblies used in conjunction with equestrian events, horseback riding, etc. have a headstall that oftentimes includes a bit. These bridle assemblies are used with a wide variety of animals, including horses, donkeys and mules. The bit is installed in the animal's mouth and hinges at the corners of the animal's mouth. A rider directs the animal by pulling on the reins in the direction the rider desires the animal to go. When the rider pulls the reins, and consequently the bit to one side, the bit may slide through the mouth of the animal. This occurrence creates discomfort for the animal and lessens the degree of control the rider has when the bit is properly in place inside the animal's mouth. In addition, as the animal moves, the bit may hinge as the rider pulls on the reins. This hinging movement can pinch the corners of the animal's mouth causing considerable discomfort and possible injury to the animal, as well as creating a dangerous riding environment for the rider.

Consequently, a bit guard that is easily installed onto a bit and minimizes the potential for discomfort to the animal and loss of control to the rider would be useful.

SUMMARY OF THE INVENTION

In one aspect of the present invention, a mouth protection apparatus includes a substantially planar bit guard including first and second sides, and an inner aperture with first and second detachable arcuate members. A first connection edge is releasably engageable with a second connection edge, wherein the first connection edge and the second connection edge define a first slit that intersects the inner aperture. A first tab extends from the first connection edge and is engaged with a first tab receiving aperture disposed proximate the second connection edge. A second tab extends from the second connection edge and is engaged with a second tab receiving aperture disposed proximate the first connection edge.

Another aspect of the present invention includes a mouth protection apparatus having a circular bit guard with first and second sides and an outer perimeter, a rounded edge and an inner aperture. A first connection edge is adjacent a second connection edge, and the first connection edge and the second connection edge extend inward from the outer perimeter and intersect the inner aperture.

In another aspect of the present invention, a method of protecting a mouth of an equine animal includes providing a bit guard having an inner aperture with first and second arcuate members and a first connection edge releasably engageable with a second connection edge. The first connection edge or the second connection edge includes a tab member and the other of the first connection edge or the second connection edge is proximate a tab member receiving aperture. The inner aperture of the bit guard is placed around a bit and the tab member is engaged with the tab member receiving aperture to positively secure the bit guard onto the bit.

These and other features, advantages and objects of the present invention will be further understood and appreciated by those skilled in the art upon studying the following specification, claims, and appended drawings.

DETAILED DESCRIPTION OF PREFERRED EMBODIMENTS

Figure 1:
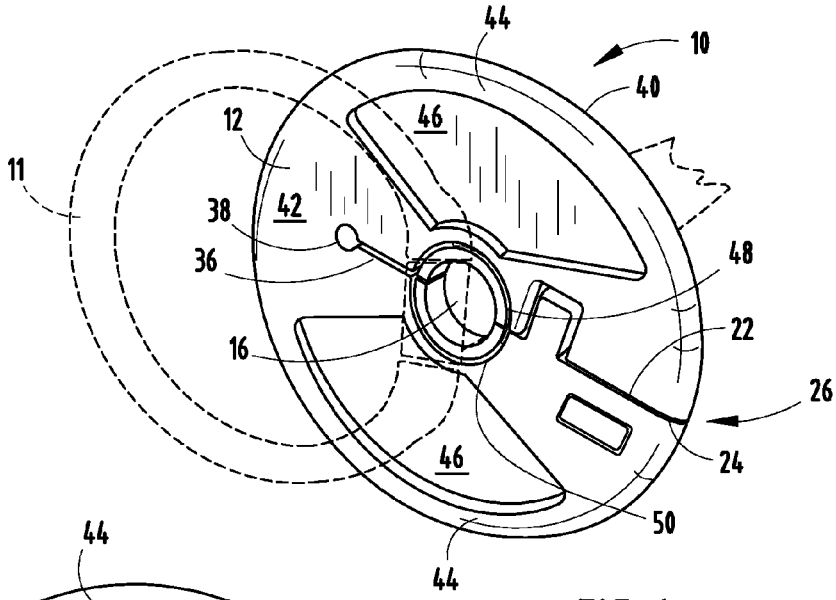
FIG. 1 is a perspective view of the bit guard embodying the present invention.

For purposes of description herein the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
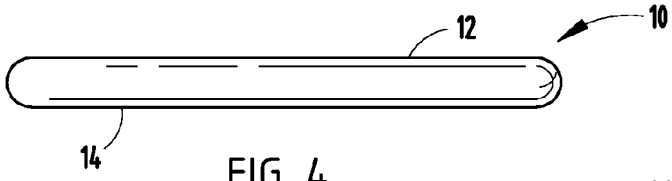
FIG. 4 is a top view of the bit guard of FIG. 1.
Figure 5:
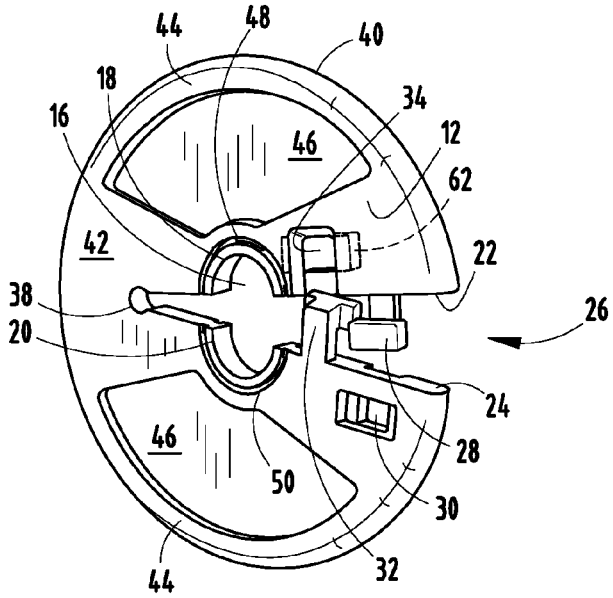
FIG. 5 is a perspective view of the bit guard of FIG. 1, with first and second connection edges disengaged.
Figure 6:
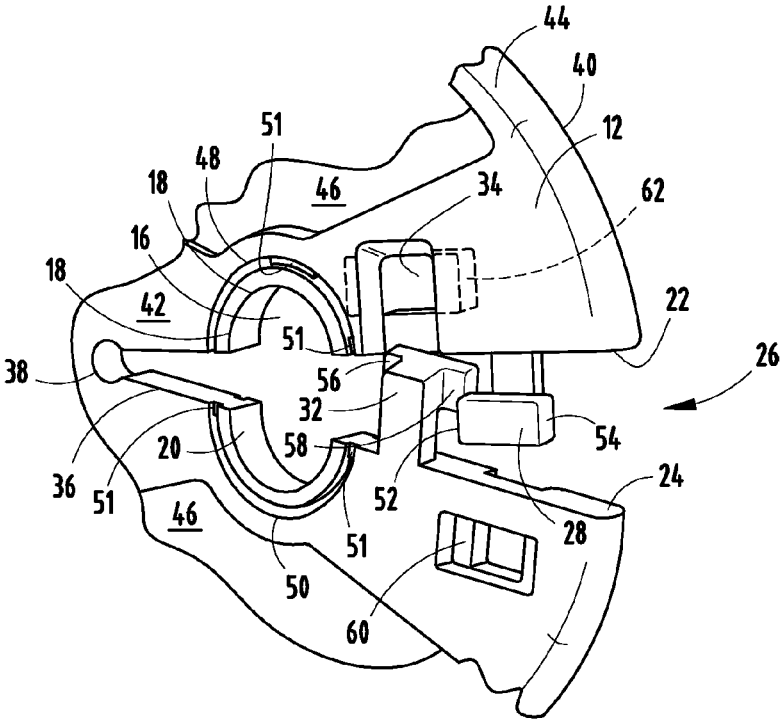
FIG. 6 is an enlarged top partial perspective view of the bit guard of FIG. 5 with first and second connection edges disengaged.

Referring to FIGS. 1, 4 and 5, the reference numeral 10 generally designates a bit guard for use on a bit 11 that includes first and second sides 12, 14, and an inner aperture 16 with first and second removable arcuate members 18, 20. A first connection edge 22 is releasably engageable with a second connection edge 24 and the first connection edge 22 and the second connection edge 24 define a slit 26 that intersects the inner aperture 16. A first tab 28 extends from the first connection edge 22, the first tab 28 being adapted for insertion into a first tab receiving aperture 30 disposed proximate the second connection edge 24. A second tab 32 extends from the second connection edge 24, the second tab 32 being adapted for insertion into a second tab receiving aperture 34 disposed proximate the first connection edge 22.

Figure 2:
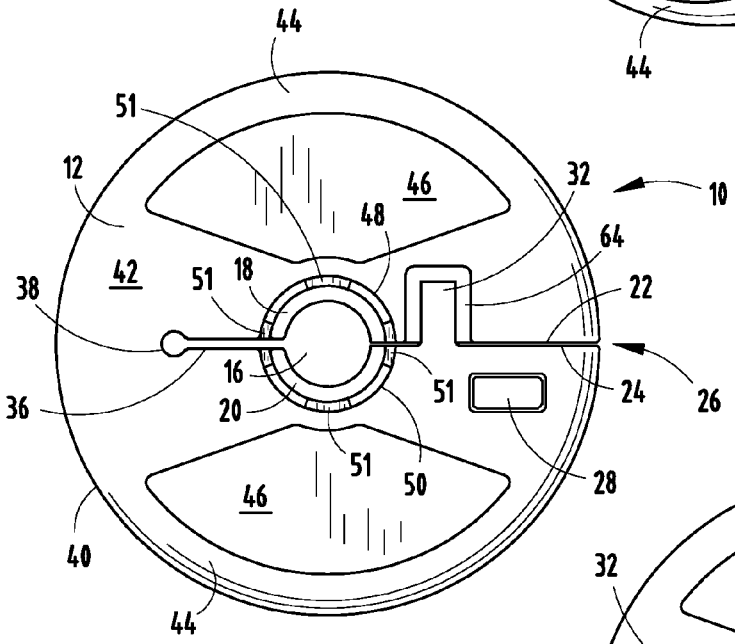
FIG. 2 is an elevational view of a first side of the bit guard of FIG. 1.
Figure 3:
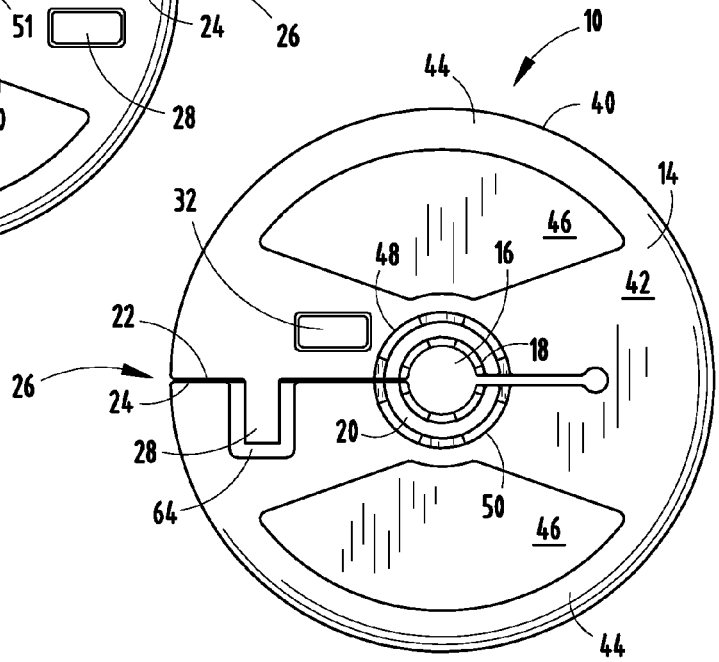
FIG. 3 is an elevational view of a second side of the bit guard of FIG. 1.

As shown in FIGS. 2 and 3, the slit 26 of the bit guard 10 has a distal portion 36 that extends beyond the inner aperture 16 and terminates at a hinge hole 38. This arrangement provides additional clearance for insertion of a bit into the inner aperture 16. Alternatively, it is contemplated that the slit 26 may terminate at the inner aperture 16. Although the slit 26 is shown extending radially inwardly from an outer perimeter 40 of the bit guard 10, it is contemplated that the slit 26 could extend inwardly toward the inner aperture 16 at any angle. The bit guard 10 also includes a reinforcement section 42 that surrounds the inner aperture 16 and extends to the outer perimeter 40 of the bit guard 10. A rim 44 extends around the outer perimeter 40 on the first and second sides 12, 14 of the bit guard 10 orthogonal to the planar extent of the first and second sides. The rim 44 has a thickness generally equal to the thickness of the reinforcement section 42. First and second recessed areas 46 extend between the rim 44 and the reinforcement section 42 on both the first and second sides 12, 14 of the bit guard 10.

Referring to FIGS. 2, 3 and 5, the arcuate members 18, 20 are connected to inner arcuate walls 48, 50 by of the inner aperture 16 by attachment members 51. The arcuate members 18, 20 are designed to be compressed against the inner arcuate walls 48, 50 of the inner aperture 16 or removed completely from the inner aperture 16. This creates substantial versatility in the size bit on which the bit guard 10 may be placed. More specifically, the additional arcuate members allow the bit guard to be placed on bits having various diameters. It is contemplated that additional arcuate members could be present and connected to the arcuate members 18, 20 to provide even more versatility.

Referring again to FIGS. 2, 3 and 5, the first tab 28 includes first and second engagement flanges 52, 54 that extend outwardly from a distal end of the first tab 28. Similarly, the second tab 32 includes first and second engagement flanges 56, 58 that extend outwardly from a distal end of the second tab 32. The first and second engagement flanges 52, 54 of the first tab 28 are adapted to be inserted into the first tab receiving aperture 30 and be retained in flange receiving indents 60 adjacent the first tab receiving aperture 30. Likewise, the first and second engagement flanges 56, 58 of the second tab 32 are adapted to be inserted into the second tab receiving aperture 34 and be retained in flange receiving indents 62 adjacent the second tab receiving aperture 34. The first and second tab receiving apertures 30, 34 include tapered walls 64 that assist a user insert the first and second tabs 28, 32 into the first and second tab receiving apertures 30, 32, respectively. Also, as shown in FIG. 4, the outer perimeter of the bit guard 10 is rounded and smooth.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A mouth protection apparatus comprising:

a substantially planar bit guard including first and second sides;

an inner aperture with first and second removable arcuate members;

a first connection edge releasably engageable with a second connection edge, wherein the first connection edge and the second connection edge define a first slit that intersects the inner aperture;

a first tab extending from the first connection edge and engaged with a first tab receiving aperture disposed proximate the second connection edge; and a second tab extending from the second connection edge and engaged with a second tab receiving aperture disposed proximate the first connection edge.

2. A mouth protection apparatus as set forth in claim 1, wherein:

a distal portion of the slit extends beyond the inner aperture and terminates at a hinge hole.

3. A mouth protection apparatus as set forth in claim 2, including:

a reinforcing section that surrounds the distal portion of the slit.

4. A mouth protection apparatus comprising:

a circular bit guard including first and second sides and an outer perimeter, a rounded edge; and an inner aperture, a first connection edge adjacent a second connection edge, wherein the first connection edge and the second connection edge extend inward from the outer perimeter and intersect the inner aperture first and second arcuate members disposed inside the inner aperture and connected to an inside circular wall that defines the inner aperture.

5. A mouth protection apparatus as set forth in claim 4, including:

a reinforcing section that surrounds the first connection edge and the second connection edge.

6. A mouth protection apparatus as set forth in claim 5, including:

a rim that extends orthogonal to the first and second sides at the outer perimeter, wherein the rim and reinforcing sections define at least one recessed section.

7. A mouth protection apparatus as set forth in claim 6, including:

a first tab extending outwardly from the first connection edge in a direction toward the second connection edge.

8. A mouth protection apparatus as set forth in claim 7, including:

first and second engagement flanges that extend outwardly from a distal end of the first tab.

9. A mouth protection apparatus as set forth in claim 8, including:

a second tab extending outwardly from the second connection edge in a direction toward the first connection edge.

10. A mouth protection apparatus as set forth in claim 9, including:

first and second engagement flanges that extend outwardly from a distal end of the second tab.

11. A mouth protection apparatus as set forth in claim 10, including:

a first tab receiving aperture disposed on the second side of the circular bit guard.

12. A mouth protection apparatus as set forth in claim 11, including:

flange receiving indents adapted to receive the first and second engagement flanges disposed adjacent the first tab receiving aperture.

13. A mouth protection apparatus as set forth in claim 12, including:

a second tab receiving aperture disposed on the first side of the circular bit guard.

14. A mouth protection apparatus as set forth in claim 13, including:

flange receiving indents adapted to receive the first and second engagement flanges disposed adjacent the second tab receiving aperture.

15. A method of protecting a mouth of an equine animal, comprising:

providing a bit guard having an inner aperture with first and second arcuate members and a first connection edge releasably engageable with a second connection edge, wherein the first connection edge or the second connection edge includes a tab member and wherein the other of the first connection edge or the second connection edge is proximate a tab member receiving aperture;

placing the inner aperture of the bit guard around a bit; and engaging the tab member with the tab member receiving aperture to positively secure the bit guard onto the bit.

16. The method of claim 15, further including:

removing the first and second arcuate members before placing the inner aperture of the bit guard around a bit.

17. The method of claim 16, wherein:

the bit guard includes a reinforcing section that surrounds the first connection edge and the second connection edge.

18. The method of claim 17, wherein:

the bit guard includes a rim that extends around an outer perimeter of the bit guard.

* * * * *